US006000790A

United States Patent [19]

Takagi et al.

[11] Patent Number: 6,000,790

[45] **Date of Patent: *Dec. 14, 1999**

[54] INK SUPPLY DEVICE

[75] Inventors: Jun Takagi; Junichi Yoshida; Kazuyuki Oda; Yoshihiko Fujimura, all of Kanagawa, Japan

[73] Assignee: Fuji Xerox Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/291,554

[22] Filed: Aug. 16, 1994

[30] Foreign Application Priority Data

| | | | |
|---|---|---|---|
| Aug. 19, 1993 | [JP] | Japan | 5-226494 |
| Sep. 22, 1993 | [JP] | Japan | 5-259138 |
| Sep. 30, 1993 | [JP] | Japan | 5-269900 |

[51] Int. Cl.[6] ..... B41J 2/175

[52] U.S. Cl. ..... 347/87

[58] Field of Search ..... 347/85, 87, 86, 347/93, 92

[56] References Cited

U.S. PATENT DOCUMENTS

| | | | |
|---|---|---|---|
| 3,967,286 | 6/1976 | Anderson et al. | 347/87 |
| 4,589,000 | 5/1986 | Koto et al. | 347/92 |
| 4,719,479 | 1/1988 | Kyogoku | 347/93 |
| 4,994,824 | 2/1991 | Winslow | 347/85 |
| 5,010,354 | 4/1991 | Cowger et al. | 347/87 |
| 5,409,138 | 4/1995 | Nakano | 347/85 |
| 5,453,771 | 9/1995 | Waseda et al. | 347/86 |
| 5,509,140 | 4/1996 | Koitabashi et al. | 347/87 |
| 5,552,816 | 9/1996 | Oda et al. | 347/86 |

FOREIGN PATENT DOCUMENTS

| | | | |
|---|---|---|---|
| 0 529 879 | 3/1993 | European Pat. Off. . | |
| 536 980 A2 | 4/1993 | European Pat. Off. . | |
| 0 562 733 | 9/1993 | European Pat. Off. . | |
| 0 605 183 | 7/1994 | European Pat. Off. . | |
| 57-16385 | 6/1980 | Japan . | |
| 57-2786 | 1/1982 | Japan . | |
| 59-500609 | 4/1984 | Japan . | |
| 59-95152 | 6/1984 | Japan . | |
| 60-262654 | 12/1985 | Japan . | |
| 61-35892 | 3/1986 | Japan . | |
| 62-5994 | 1/1987 | Japan . | |
| 63-87242 | 4/1988 | Japan . | |
| 63-231759 | 9/1988 | Japan . | |
| 64-35215 | 2/1989 | Japan . | |
| 1-148559 | 6/1989 | Japan . | |
| 2-34354 | 2/1990 | Japan . | |
| 3-41351 | 2/1991 | Japan . | |
| 3-180357 | 8/1991 | Japan . | |
| 3-189157 | 8/1991 | Japan . | |
| 3-258554 | 11/1991 | Japan . | |
| 488829 | 6/1992 | Japan | B41J 2/175 |
| 4-296566 | 10/1992 | Japan . | |
| 6-238908 | 8/1994 | Japan . | |
| 7-068785 | 3/1995 | Japan . | |

*Primary Examiner*—N. Le
*Assistant Examiner*—Judy Nguyen
*Attorney, Agent, or Firm*—Oliff & Berridge, PLC

[57] ABSTRACT

In an ink tank, a main ink chamber is contiguous to a sub ink chamber containing an absorption member, and an air communication hole is formed on the top of the sub ink chamber. The absorption member holds ink pressure constant by capillary attraction of the absorption member. First, ink in the sub ink chamber is consumed with consumption of ink. When ink is consumed in a predetermined amount, air passes through the absorption member and a meniscus forming portion to form bubbles, which then move to the main ink chamber. Ink pressure is held constant by surface tension of the meniscus forming portion. Even if ink remains in a small amount, the ink leading portion makes the meniscus forming portion wet for holding ink pressure.

20 Claims, 11 Drawing Sheets

FIG.3(A)
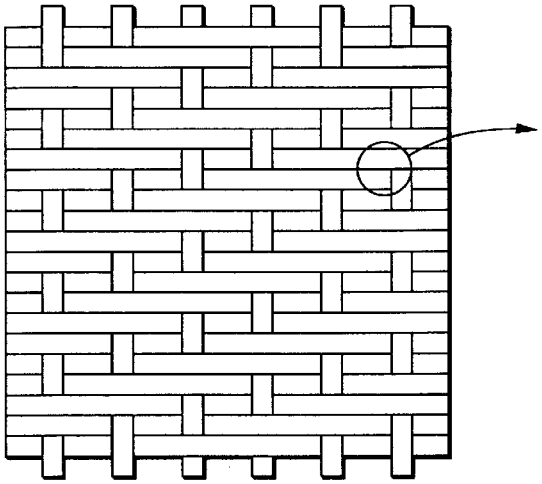
FIG.3(C)
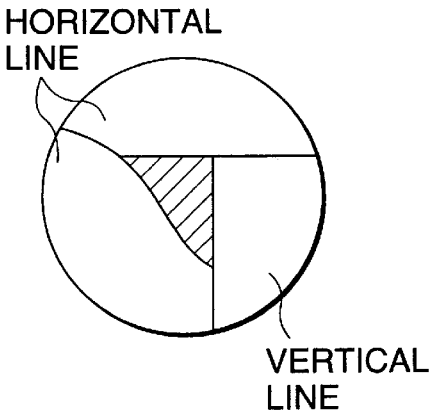
FIG.3(B)
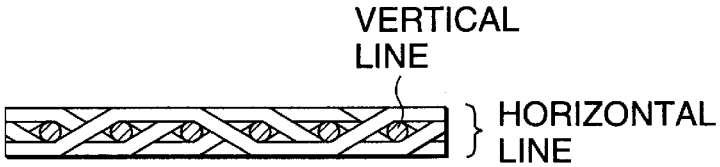
FIG.4
| | FILTER MATERIAL, ETC. | LINE DIAMETER LENGTH× BREADTH (μ) | TRANS-MITTED GRAIN SIZE (μ) | FLUID RESISTANCE AVERAGE DIFFERENCE ($g/cm^4S$) | PRES-SURE LOSS ($cmH_2O$) |
|---|---|---|---|---|---|
| A | SUS TWILLED DUTCH WEAVE 200×1400 | 71×41 | 10 | $10.3\times10^4$ | 4.2 |
| B | SUS TWILLED DUTCH WEAVE 325×2300 | 36×25 | 5 | $56.1\times10^4$ | 23.1 |

INK SUPPLY DEVICE

BACKGROUND OF THE INVENTION

1. Field of the Invention

This invention relates to an ink supply device for supplying ink to a recording head in an ink jet recording apparatus.

2. Description of the Related Art

In a conventional ink supply mechanism used with an ink jet recording apparatus, an ink absorber is loaded into an entire ink tank communicated with a recording head and is previously impregnated with ink and the ink in the ink absorber is supplied to the recording head, for example, as described in Japanese Patent Laid-Open No. Sho 63-87242. Porous material such as a sponge, fibrous material such as felt, or the like is used as the ink absorber. With such an ink supply mechanism, ink only in an amount as much as about 40%–60% of the capacity of the ink tank can be used so that use efficiency is low. Thus, if an attempt is made to prolong the life of the ink tank, inevitably the ink tank becomes large-sized, as a result of which a demand for miniaturization is not met.

Since the conventional ink supply mechanism holds ink by capillary attraction of the ink absorber, appropriate negative pressure is generated for the recording head. Thus, when the amount of ink held in the ink absorber decreases with consumption of the ink, negative pressure acting on the ink with which the ink absorber is impregnated rises gradually from a decrease in water head, impeding ink supply to the recording head. When the phenomenon develops and the negative pressure applied to the ink exceeds a given value, bubbles flow reversely from a print nozzle section of the recording head and the spout operation of ink is performed with no ink supplied to the recording head. Thus, spout failure causes a record image to become defective, lowering the picture quality. This phenomenon also causes the use efficiency of ink to lower.

To solve such problems, in ink supply devices described in Japanese Patent Laid Open Nos.Sho 59-500609, Hei 1-148559, 3-180357, etc., for example, a hermetically sealed ink tank is filled only with ink and a capillary having one end open to the air is communicated with the ink tank or the ink tank is formed with a small hole. According to the ink supply devices, when negative pressure in the ink tank increases with consumption of ink in the ink tank, air is introduced through the capillary or small hole into the ink tank for holding the negative pressure value in the ink tank substantially constant, enabling the ink in the ink tank to be stably supplied to the recording head.

When environment changes, for example, if air in the upper space of the ink tank expands, the ink in the ink tank flows reversely through the capillary. Thus, there is a chance that the reversely flowing ink will spout in the ink supply device described in Japanese Patent Laid-Open No. Sho 59-500609 or in one example of the ink supply device described in Japanese Patent Laid-Open No. Hei 1-148559 because the air and the ink tank are communicated with each other only via the capillary. Although the capillary may be lengthened, the structure becomes complicated.

Another example of the ink supply device described in Japanese Patent Laid-Open No. Hei 1-148559 or the ink supply device described in Japanese Patent Laid-Open No. Hei 3-180357 has a small chamber. If air in the upper space of the ink tank expands, the ink in the ink tank is temporarily saved in the small chamber, thereby lowering pressure in the ink tank, thus effectively preventing ink from leaking from the recording head or the capillary or small chamber communicated with the air.

However, the ink supply devices have the small chamber disposed in the lower portion of a main ink chamber. Therefore, when the ink moved to the small chamber to relieve pressure change in the ink tank is restored to the main ink chamber, the ink must overcome capillary attraction and be moved against the gravity direction. Thus, the ink in the ink tank cannot completely be restored to the main ink chamber and some of the ink remains in the small chamber. That is, the capacity efficiency is lowered by the remaining amount of ink.

SUMMARY OF THE INVENTION

It is therefore an object of the invention to provide an ink supply device which has stable ink supply performance, can suppress the effect of environment change, and is improved in ink storage efficiency.

To the end, according to the invention, there is provided an ink supply device for supplying ink to the ink jet head, comprising a main ink storage chamber being communicated with the ink jet head for storing ink, a sub ink storage chamber being contiguous to a side of the main storage chamber and communicated with the main storage chamber via a communication hole on a lower space and formed with an air communication opening on a top of the sub ink storage chamber, an ink absorption member being disposed inside the sub ink storage chamber so that at least sides of the ink absorption member adhere to inner walls of the sub ink storage chamber, and a meniscus forming portion formed so as to cover the communication hole of the sub ink storage chamber. The meniscus forming portion can be made of a mesh substance or porous substance.

The ink supply device may further include an ink leading portion being in contact with a lower face of the meniscus forming portion and extending within the lower space communicated with the main ink storage chamber. The ink leading portion can have one end being in contact with the meniscus forming portion and the other end being in contact with the bottom of the lower space communicated with the main ink storage chamber. The ink leading portion has a section formed smaller than the communication hole and a noncontact region with the ink leading portion is formed in the meniscus forming portion.

Further, a filter having higher filtration precision than the meniscus forming portion can be disposed between the main ink storage chamber and the ink jet head.

According to the invention, the ink supply device comprises the main ink storage chamber and the sub ink storage chamber and the ink absorption member is inserted into the sub ink storage chamber, thus ink does not leak to the outside, the internal negative pressure can be controlled, and the negative pressure applied to the ink jet head can be kept within any desired range.

The ink absorption member in the sub ink storage chamber can absorb ink to the maximum holding capability of the absorption member by a capillary phenomenon at the initial stage and serves as an ink chamber. The sub ink storage chamber has the air communication hole on the top and is communicated with the main ink storage chamber in the lower space of the ink absorption member inserted tightly into the sub ink storage chamber, so that ink in the sub ink storage chamber moves to the main ink storage chamber under negative pressure generated as ink is consumed at the recording head. When the ink in the sub ink storage chamber substantially runs out, bubbles occur from the meniscus forming portion and are supplied via the lower space to the main ink storage chamber, thereby suppressing a rise in negative pressure in the main ink storage chamber, thereby always generating proper negative pressure at the recording head to ensure good printing.

When further the environment changes and pressure in the main ink storage chamber rises, ink flows into the sub ink storage chamber from the main ink storage chamber through the non-contact region, so that the pressure in the main ink storage chamber can be held substantially constant. In such a case, the ink flowing into the sub ink storage chamber is restored to the main ink storage chamber when pressure lowers due to consumption of ink. Therefore, the amount of ink remaining in the sub ink storage chamber can be reduced and volume efficiency can be raised.

The meniscus forming portion is made of a mesh or porous substance, whereby an ink meniscus can be formed in the hole part of the mesh or porous substance. Bubbles can be generated at desired differential pressure from atmospheric pressure by surface tension of the meniscus for keeping the main ink storage chamber at substantially constant negative pressure.

If both faces of the meniscus forming portion come in contact with an air layer by bubbles, etc., generated in the meniscus forming portion, ink is sucked up by the ink leading portion for supplying the ink to the meniscus forming portion, so that the meniscus forming portion is always held wet with ink and negative pressure in the main ink storage chamber can be held substantially constant by surface tension of ink in the meniscus forming portion. If ink lessens and its liquid face falls below the meniscus forming portion, likewise the meniscus forming portion can be held wet with ink and the remaining amount of ink can be reduced.

The ink leading portion can have one end being in contact with the meniscus forming portion and the other end being in contact with the bottom of the lower space communicated with the main ink storage chamber. In this structure, if ink remains in a small amount, ink is supplied from the ink leading portion to the meniscus forming portion and pressure in the main ink storage chamber is held substantially constant by the function of the meniscus forming portion. Thus, ink can be consumed completely for furthermore improving use efficiency of ink.

Further, the ink leading portion can have a section formed smaller than the communication hole and a noncontact region with the ink leading portion can be formed in the meniscus forming portion. In this structure, bubbles can be generated in the region and the generated bubbles can be moved smoothly to the lower space.

A filter having higher filtration precision than the meniscus forming portion is disposed between the main ink storage chamber and the ink jet head, whereby pressure control by means of the absorption member, the meniscus forming portion, and the ink leading portion when the environment changes can be promoted for preventing ink from flowing out from the ink jet head.

The above and other objects and features of the present invention will be more apparent from the following description taken in conjunction with the accompanying drawings.

BRIEF DESCRIPTION OF THE DRAWINGS

In the accompanying drawings:

FIGS. 3(A) to 3(C) are explanatory diagrams showing one example of mesh substance that can be used for a meniscus forming portion;

FIG. 4 is a table showing characteristics of wire nets of twilled Dutch Weave;

DETAILED DESCRIPTION OF PREFERRED EMBODIMENTS

Referring now to the accompanying drawings, there are shown preferred embodiments of the invention.

Figure 1:
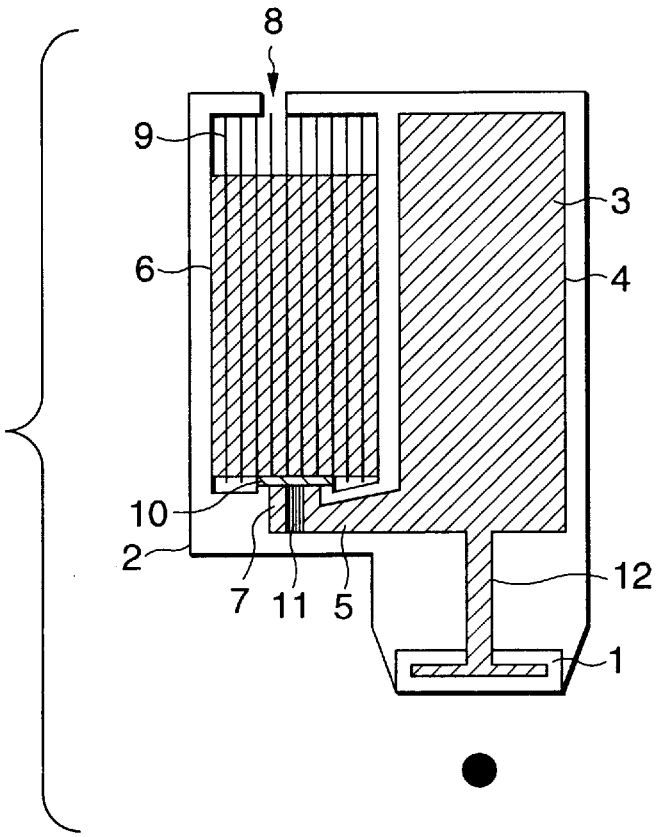
FIG. 1 is a sectional view showing an ink supply device according to one embodiment of the invention.
Figure 2:
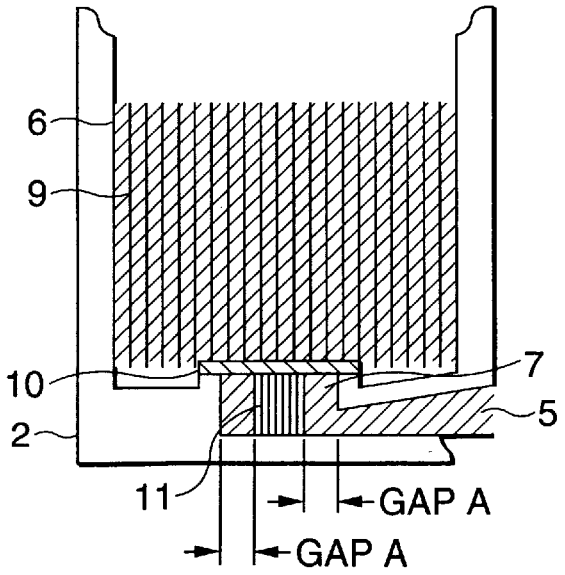
FIG. 2 is an enlarged view showing the lower portion of a sub ink chamber.

FIG. 1 is a sectional view showing an ink supply device according to one embodiment of the invention. FIG. 2 is an enlarged view of the lower portion of a sub ink chamber. In the figures, numeral 1 is an ink jet head, numeral 2 is an ink tank, numeral 3 is ink, numeral 4 is a main ink chamber, numeral 5 is a communication passage, numeral 6 is a sub ink chamber, numeral 7 is a communication hole, numeral 8 is an air communication hole, numeral 9 is an absorption member, numeral 10 is a meniscus forming portion, numeral 11 is an ink leading portion, and numeral 12 is a supply passage. In the embodiment, the ink jet head 1 is integral with the ink tank 2. The ink jet head 1 is surrounded by components such as a heat sink (not shown) to which the head is attached and a printed wiring board (not shown) for supplying electric signals to the ink jet head 1. The ink jet head 1 is formed with a large number of nozzles (not shown) at high density. For example, 128 nozzles can be formed at the density of 300 spi. Each nozzle is provided with a heating element (not shown) for generating bubbles upon energization for jetting ink drops. In FIG. 1, ink drops are jetted downward.

The inside of the ink tank 2 is divided into the main ink chamber 4 and the sub ink chamber 6. To provide rigidity and enable ink storage for a long term, material good in resistance to ink is selected for the housing of the ink tank 2. Only ink is stored in the main ink chamber 4. Ink is supplied from the main ink chamber via the supply passage 12 to the ink jet head 1.

The communication hole 7 is formed on the bottom of the sub ink chamber 6 for communicating with the main ink chamber 4 via the communication passage 5. The section of the communication hole 7 can be formed like a circle, ellipse, polygon, start, cross, slit, or the like. The upper wall of the communication passage 5 may be formed flat; however, as shown in the figures, it is inclined so as to rise gradually toward the main ink chamber 4, whereby bubbles occurring on the communication hole 7 can be moved smoothly to the main ink chamber 4. An absorption member 9 is located in the sub ink chamber 6. Fibrous material having a two-dimensional structure, porous material having a three-dimensional structure, felt provided by spinning fibrous material into a three-dimensional form, or nonwoven fabric can be used as material of the absorption member 9. Specifically, for example, inner cotton material provided by bundling polyester fiber in one direction can be used. Polyester felt at the density (=weight/volume) of 800 g/m$^3$ can be used as the inner cotton material. Polyester felt at the volume density in the range of 5%–15% can be used; it is desirable to use polyester fiber having a value in such a degree from the viewpoints of fluid resistance and capillary attraction. The material is not limited to polyester fiber. For example, a porous member such as polyurethane or melamine form or a one- or two-dimensional fiber structure can be used if the material has moderate capillary attraction and is resistant to ink.

The air communication hole 8 through which the air can be communicated to the absorption member 9 is installed on the top of the sub ink chamber 6. In the embodiment, the diameter of the air communication hole 8 is made larger than a hole of the absorption member 9 or a gap between fibers. The absorption member 9 is communicated with the air on the top and atmospheric pressure release is made. Ink in the absorption member 9 is pressed under atmospheric pressure and is drawn into the main ink chamber side under negative pressure from the bottom of the absorption member 9, so that the ink in the absorption member 9 can be used efficiently. At the time, the negative pressure in the main ink chamber 4 is held constant by capillary attraction of the absorption member 9. The air communication hole 8 can also be formed with a sheet allowing air to be transmitted without transmitting ink for preventing the ink from popping out of the air communication hole 8. Alternatively, the air communication hole 8 can also be provided with a large number of minute holes through which ink does not flow out. The absorption member 9 is inserted into the sub ink tank 6 so that the periphery of the absorption member 9 adheres to the inner wall of the sub ink tank 6 for the purpose of preventing air introduced through the air communication hole 8 from entering along the inner wall of the sub ink tank 6.

The meniscus forming portion 10 is disposed so as to cover the communication hole 7 and come in contact with the bottom of the absorption member 9. For example, it can also be located so as to protrude by several millimeters from the bottom of the absorption member 9, in which case the absorption member 9 is pressed against the meniscus forming portion 10 and the surface of the meniscus forming portion 10 is immersed in the absorption member 9 for providing better fluid junction. The meniscus forming portion 10 can use a mesh substance such as a wire net or resinous net, a porous substance, or the like. Specific examples of available mesh substances include a metal mesh filter, a filter using material provided by forming a metal fiber, such as a thread of SUS, like felt and further compressing and sintering it, and an electroforming metal filter. In addition, a filter of knitted goods of resin fiber and a filter having a very accurate hole diameter provided by laser beam machining, electronic beam machining, etc., can be used. The meniscus forming portion 10 can be thermally welded to the absorption member 9.

When ink is absorbed in the absorption member 9, the ink is moved through the meniscus forming portion 10 to the main ink chamber 4. Even if ink runs out in the absorption member 9, the meniscus forming portion 10 prevents unnecessary air from entering the main ink chamber. When ink is further consumed, air coming through the air communication hole 8 passes through the absorption member 9; when negative pressure in the main ink chamber 4 increases, the air presses the liquid face of ink on the meshes of the meniscus forming portion 10 adhering to the absorption member 9, overcomes surface tension, passes through the meniscus forming portion 10, and becomes bubbles. The bubbles move through the communication hole 7 to the main ink chamber 4. The pressure when the bubbles occur (bubble point pressure) depends on the filtration precision of the meniscus forming portion 10. The negative pressure in the main ink chamber 4, namely, the supply pressure of ink to the ink jet head 1, can be held constant by optimizing the filtration precision. A substance having filtration precision of about 70 $\mu$m, for example, can be used for the meniscus forming portion 10. The meniscus forming portion 10 also serves a function of removing dust, etc., larger than the filtering precision.

FIGS. 3(A) to 3(C) are explanatory diagrams showing one example of mesh substance that can be used for the meniscus forming portion 10. To use a wire net as the meniscus forming portion 10, the wire net can be woven in various manners. FIGS. 3(A) to 3(C) show a twilled Dutch weave of a wire net. For the twilled Dutch weave, solid vertical lines are used and horizontal lines come in contact with each other and are woven so as to override every two vertical lines. As in FIG. 3(A), when the wire net is viewed from the front, it cannot be seen through because the horizontal lines come in contact with each other. However, when it is viewed slantingly, a triangle aperture is formed by a horizontal line slantingly running from rear to face or from face to rear, a straight horizontal line contiguous to the line, and a vertical line, as shown in FIG. 3(C). Ink passes through the triangle aperture and a bubble occurs in the portion. Thus, a wire net of the twilled Dutch weave can be woven with fine and even meshes for generating uniform bubbles. It has features of great mechanical strength and a heavy-duty property as compared with other wire nets having the same filtration precision. Normally, such a wire net is used for filtering; in the invention, in addition to filtering, it also serves a function of adjusting pressure by generating bubbles.

FIG. 4 is an illustration of characteristics of wire nets of twilled Dutch weave. In the figure, the wire net of twilled Dutch weave indicated as A has the filtration grain size of about $10^4$ m, fluid resistance average difference of $10.3\times10^4$ g/cm$^4$ s, and pressure loss of about 4.2 cm $H_2O$. The wire net of twilled Dutch weave indicated as B has the filtration grain size of about 5 $\mu$m, fluid resistance average difference of $56.1\times10^4$ g/cm$^4$ s, and pressure loss of about 23.1 cm $H_2O$. Thus, the fluid resistance and pressure loss vary depending on coarseness of meshes of the wire net being used. Therefore, a wire net having optimum meshes may be used by considering ink pressure applied to ink, etc.

Referring again to FIGS. 1 and 2, the ink leading portion 11 is in contact with the meniscus forming portion 10 and extends to the lower portion through the communication hole 7. If bubbles are collected on the bottom face of the meniscus forming portion 10 and an air layer is generated or if ink in the main ink chamber 4 decreases and the liquid face of the ink lowers below the diameter of the communication passage 5, both faces of the meniscus forming portion 10 are exposed to air. However, in such a case, the liquid face of ink needs to be formed in the meniscus forming portion 10 because pressure in the main ink chamber 4 needs to be held negative. Thus, the ink leading portion 11 sucks up ink from the bottom of the communication passage 5 and supplies it to the meniscus portion 10, thereby holding the meniscus forming portion 10 wet and maintaining negative pressure in the main ink chamber 4. The bottom face of the ink leading portion 11 is extended until it comes in contact with the bottom of the communication hole 7, namely, the bottom of the communication passage 5, whereby the best condition can be maintained until ink is used up. The ink leading portion 11 uses material capable of putting ink up on the meniscus forming portion 10 by capillary attraction; for example, inner cotton material provided by bundling polyester fiber in one direction, a porous member such as polyurethane or melamine form, or a two- or three-dimensional fiber structure can be used. It may take any form, such as a slit form, a rectangular parallelepiped, a prism such as a triangle pole, a cylinder, or an elliptic cylinder. As shown in FIG. 2, the sectional dimension of the ink leading portion 11 is made smaller than the opening dimension of the meniscus forming portion 10, thereby providing gaps A around the ink leading portion 11, whereby bubbles occurring in the meniscus forming portion 10 can be easily moved to the main ink chamber 4. Preferably, the gap A is 0.5 mm or more in width. The ink leading portion 11 can also be attached directly to the meniscus forming portion 10 or be fixed with a rib from the side wall of the communication hole 7.

Figure 13:
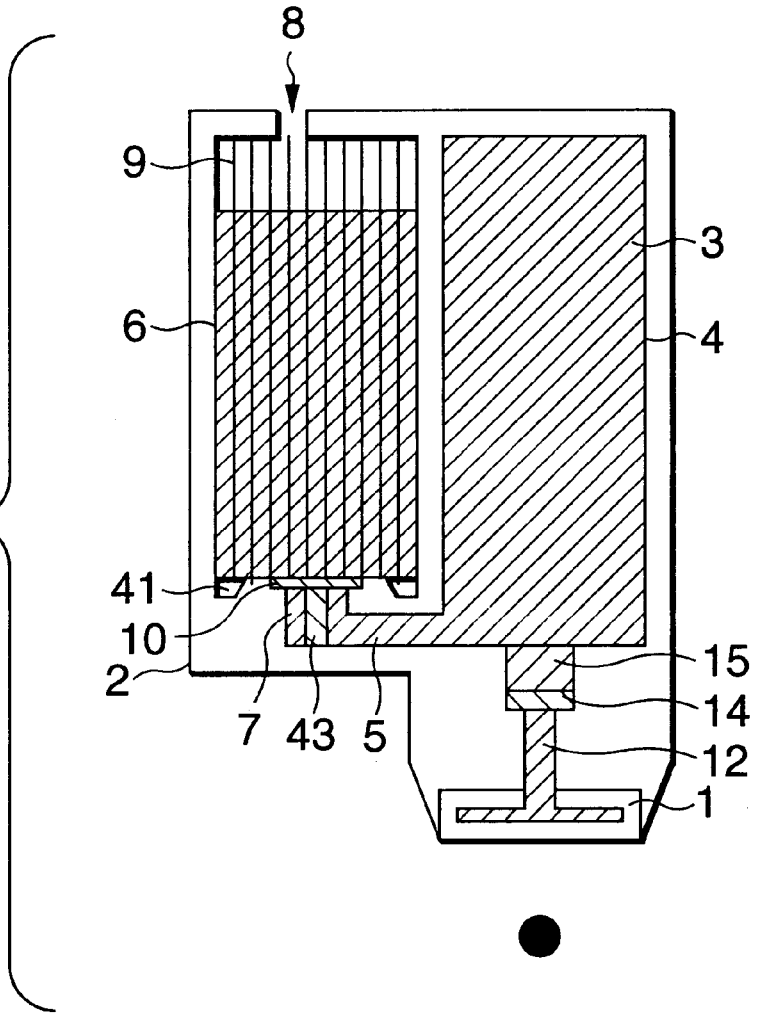
FIG. 13 is a sectional view showing an ink supply device according to a modified embodiment of the invention.
Figure 14A:
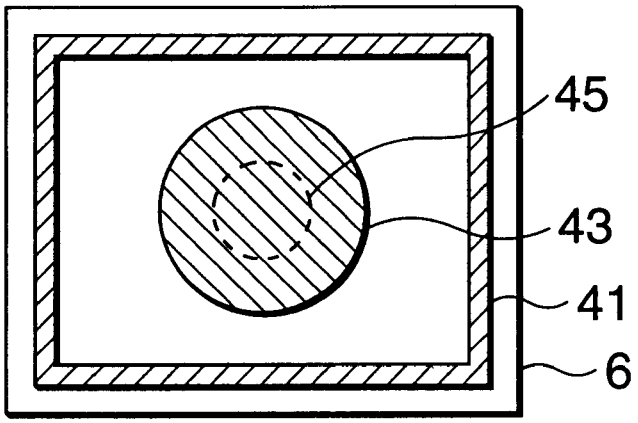
FIGS. 14(A) and 14(B) are top views showing a recess used in the ink supply device of FIG. 13.
Figure 14B:
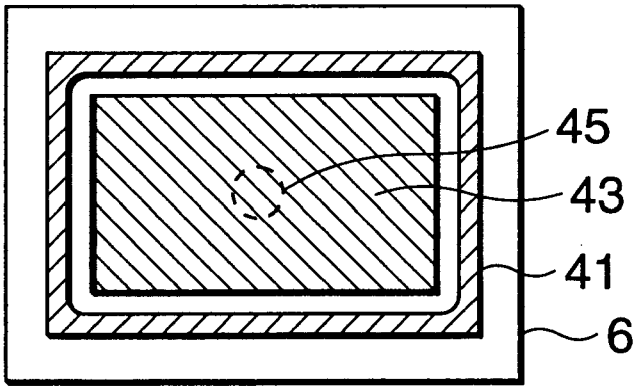
Figure 15A:
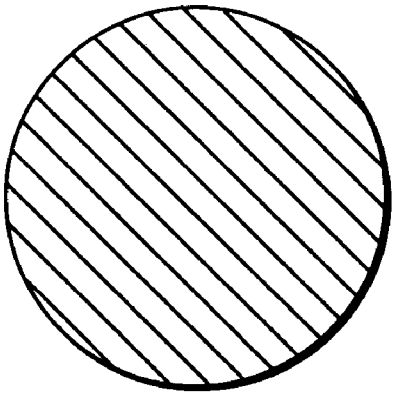
FIGS. 15(A) and 15(B) are a top view and a side view showing an ink core member used in the ink supply device of FIG. 13, respectively.
Figure 15B:
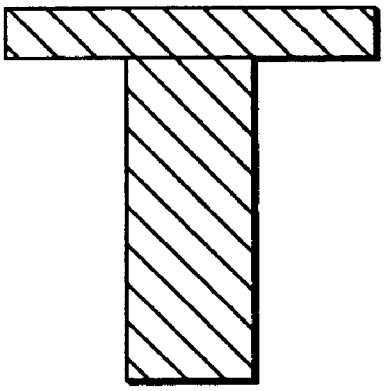

A recess 41 may be formed on the periphery of the bottom face of the sub ink chamber 6, as shown in FIG. 13. FIGS. 14(A) and 14(B) show top views of the recess 41. If fibrous material, a porous substance or the like is used as the absorption member 9 housed in the sub ink chamber 6, fluff on the periphery enters the recess 41. When the amount of ink in the sub ink chamber 6 decreases, air easily enters along the inner wall of the sub ink chamber 6. The part of the absorption member 9 entering the recess 41 becomes dense so that air entering from the periphery of the absorption member 9 is introduced into the recess 41 and trapped and can be blocked here. The size of the recess 41 can be designed appropriately depending on the bottom area of the sub ink chamber 6 and the size of the meniscus forming portion 10; for example, it can be made 1.5 mm or less in width and 4 mm or less in depth. An ink core member 43 may be formed integrally with a filter 45 in the form shown in FIGS. 15(A) and 15(B). In this case, for example, inner cotton material provided by bundling polyester fiber in one direction, a porous member such as polyurethane or melamine form, or a two- or three-dimensional fiber structure can be used as the ink core member 43. Specifically, "Sunfine" manufactured by Asahi Kasei, etc., can be used, for example. The ink core member 43 has the filtration grain degree coarser than a filter 14. FIG. 15(A) is a top view of the ink core member 43 and FIG. 15(B) is a side view thereof. The top of the ink core member 43 has a size blocking the communication hole 7. The bottom face of the ink core member 43 has a length extending to the communication passage 5. Preferably, it can be made the length extending to the bottom face of the communication passage 5. The ink core member 43 enables the number of parts to be reduced and an ink supply device to be manufactured in a fewer number of steps at low costs. The form of the ink core member 43 is not limited to the form of overlapping cylinders as shown in FIG. 14(A); it can be made a different form. For example, the ink core member 43 can be formed fitting the form of the communication hole 7.

The volume efficiency of the ink supply device is described. In the embodiment, the capacity ratio of the main ink chamber 4 to the sub ink chamber 6 is set to 1:1 and the main ink chamber 4 is filled up with ink in the initial state of the ink tank 2. On the other hand, the sub ink chamber 6 is filled with ink in an amount with which the absorption member 9 can be impregnated. For example, inner cotton material provided by bundling polyester fiber in one direction can be used as material of the ink absorption member 9. When the inner cotton material is used, the ink storage efficiency (=ink fill amount/entire ink chamber capacity) is about 80%. The ink use efficiency of the sub ink chamber 6 (=amount of ink that can be supplied/ink fill amount) is about 70%. On the other hand, the ink storage efficiency in the main ink chamber 4 (=ink fill amount/ink absorption member volume) is about 100% and the ink use efficiency (=amount of ink that can be supplied/ink fill amount) is also about 100%. Therefore, the volume efficiency of the ink tank 2 (=amount of ink that can be supplied/entire ink chamber capacity) becomes about 78%. Thus, the ink supply device of the invention is very good in use efficiency of ink.

The volume ratio of the main ink chamber to the sub ink chamber need not necessarily be 1:1 as described above. The size may be determined based on the factors such as the ink amount. As described below, ink in an amount necessary to hold the negative pressure in the main ink chamber 4 if an air layer formed in the upper portion of the main ink chamber 4 expands when temperature rises or atmospheric pressure lowers is stored in the absorption member 9 in the sub ink chamber. The amount of ink stored at the time needs to be considered to set the volume of the absorption member 9.

In addition to the form of dividing the ink tank into two chambers as shown in FIG. 1, the positional relationship between the main and sub ink chambers may be a form of surrounding two or three sides of the sub ink chamber by the main ink chamber or a structure in which the sub ink chamber is located like an island in the main ink chamber. In the form or structure, if all or some of the sides of the ink tank are made of transparent substance, the liquid face in the main ink chamber can be checked in any direction by a method such as visual inspection or an optical sensor.

The operation of the ink supply device of the invention is described. The state shown in FIG. 1 indicates that the ink tank 2 is filled with ink. In the state, the ink tank 2 is filled with ink as about 80% of the inner capacity of the absorption member 9 and 100% of the inner capacity of the main ink chamber 4. The ink pressure at the ink jet head 1 can be set to −20 mm $H_2O$, for example. The ink pressure is provided by capillary attraction of the absorption member 9 for holding ink. Although it is desirable to fill up the ink tank 2 with ink as much as possible from the viewpoint of ink use efficiency in the initial state, the absorption member needs to contain some portion not filled with ink in order to generate negative pressure by the capillary attraction of the absorption member 9. Before use, a seal can be put on the nozzle section of the ink jet head 1 and the air communication hole 8. In the condition, the ink supply device is packed.

When printing starts, ink is consumed at the ink jet head 1 and ink in an amount as much as the consumed ink amount is supplied from the main ink chamber 4 via the supply passage 12 to the ink jet head 1. While the absorption member 9 holds ink, ink in the absorption member 9 moves via the communication passage 5 to the main ink chamber 4 and air diffuses gradually into the absorption member 9 through the air communication hole 8.

Figure 5A:
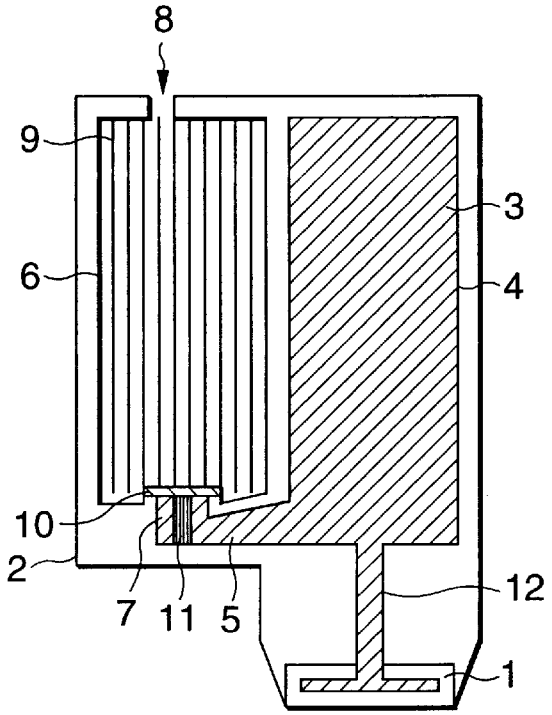
FIGS. 5(A) to 5(C) are explanatory diagrams showing an ink consumption process.
Figure 5B:
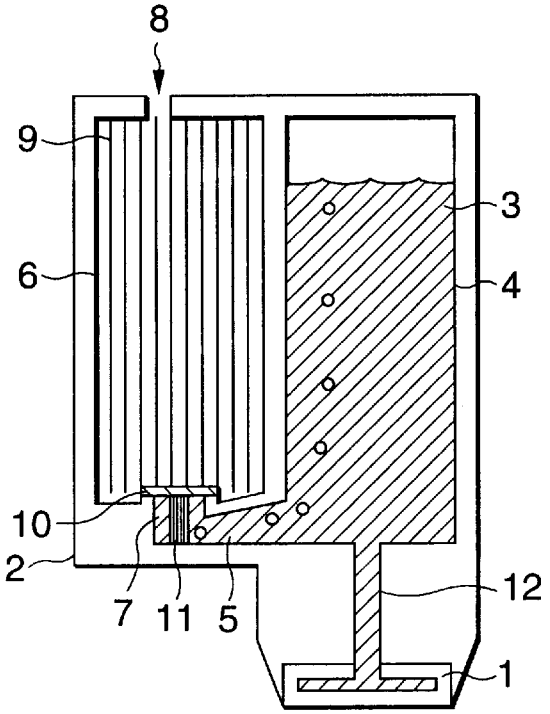
Figure 5C:
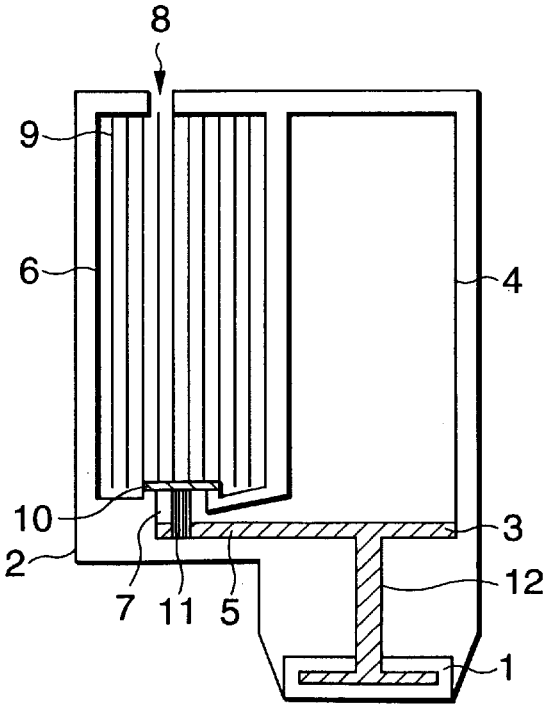

FIGS. 5(A) to 5(C) are explanatory diagrams showing process of ink consumption. FIG. 5(A) shows a state in which air arrives at the meniscus forming portion 10 as ink is consumed. The meniscus forming portion 10 prevents air from entering the main ink chamber 4 until the state is entered. Thus, the remaining amount of ink in the absorption member 9 can be lessened. At the point in time, a meniscus where ink and air come in contact with each other is formed on the meniscus forming portion 10. Although air comes in contact with the top face of the meniscus forming portion 10, movement of ink continues with the air trapped on the meniscus forming portion 10 because the meniscus forming portion 10 has finer filtration precision than the absorption member 9.

As ink is further consumed, the ink water head decreases, thereby increasing the negative pressure gradually. When a given negative pressure value (bubble point pressure of filer and ink determined by the filtration precision of the meniscus forming portion 10) is applied to the meniscus forming portion 10, air becomes small bubbles through the ink meniscus formed on the meniscus forming portion 10. These small bubbles are combined with contiguous small bubbles and subsequent bubbles to form large bubbles, which then move through the communication passage 5 to the inside of the main ink chamber 4. At the time, since the upper wall of the communication passage 5 is formed diagonally toward the main ink chamber 4, the bubbles move smoothly on the communication passage 5 to the main ink chamber 4.

When ink is absorbed in the absorption member 9, the ink is moved through the contact region of the ink leading portion 11 and the the meniscus forming portion 10 to the main ink chamber 4. Even if ink runs out in the absorption member 9, the meniscus forming portion 10 prevents unnecessary air from entering the main ink chamber. When ink is further consumed, air coming through the air communication hole 8 passes through the absorption member 9; when negative pressure in the main ink chamber 4 increases, the air presses the liquid face of ink on the meshes of the meniscus forming portion 10 adhering to the absorption member 9, overcomes surface tension, passes through the meniscus forming portion 10, and becomes bubbles. The bubbles move through the communication hole 7 to the main ink chamber 4. The pressure when the bubbles occur (bubble point pressure) depends on the filtration precision of the meniscus forming portion 10. The subsequent supply pressure of ink to the ink jet head 1 can be held constant by optimizing the filtration precision. The bubbles moving to the main ink chamber 4 are collected in the upper portion of the main ink chamber 4, as shown in FIG. 5(B).

Figure 6A:
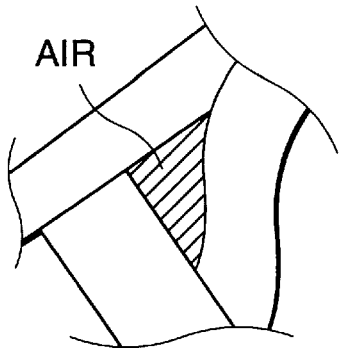
FIGS. 6(A) to 6(D) are explanatory diagrams showing a bubble generation process on a wire net of twilled Dutch weave.
Figure 6B:
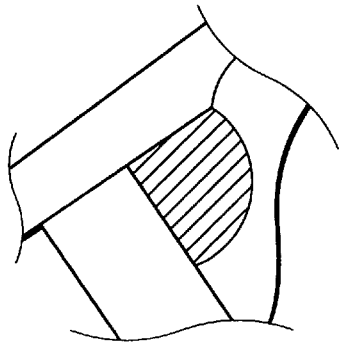
Figure 6C:
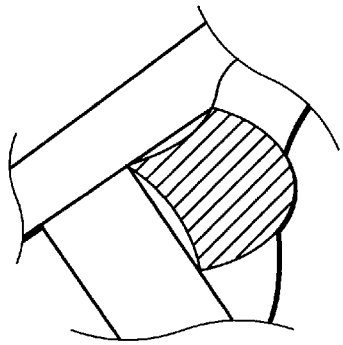
Figure 6D:
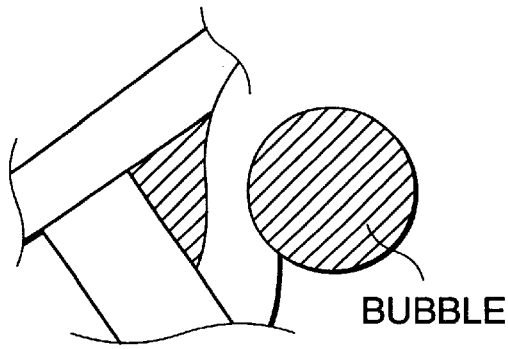

The bubble generation process in the meniscus forming portion 10 at the time is described. FIGS. 6(A) to 6(D) are explanatory diagrams showing the bubble generation process on a wire net of twilled Dutch weave. Use of the wire net of twilled Dutch weave shown in FIGS. 3(A) to 3(C) as the meniscus forming portion 10 is taken as an example for the description of the bubble generation process. As shown in FIG. 3(C), the wire net of twilled Dutch weave has triangle apertures. If the aperture part is wet with ink, an ink film is formed by surface tension of ink. While a pressure balance is kept between both faces of the wire net, the ink film is flat, as shown in FIG. 6(A). In FIGS. 6(A) to 6(D), when the pressure on the surface of the wire net lowers, the pressure difference between both the faces causes air on the rear of the wire net to press the ink film for forming a convexity as shown in FIG. 6(B). Further, when the pressure on the surface of the wire net lowers, the convexity fills out as shown in FIG. 6(C). At last, it becomes a bubble and is separated in ink, as shown in FIG. 6(D). At the point in time, the pressure in the ink rises as much as the volume of the bubble, negating the drop in the pressure on the surface of the wire net. Thus, the ink film becomes flat. The bubble separated in the ink is combined with bubbles likewise generated from near meshes to form a large bubble, which then moves to the main ink chamber 4.

Referring again to FIGS. 5(A) to 5(C), when the ink is further consumed, the liquid face of the ink does not fill the communication passage 5, as shown in FIG. 5(C). In this state, both faces of the meniscus forming portion 10 are exposed to air. However, since the ink leading portion 11 is immersed in the ink, a capillary phenomenon of the ink leading section 11 causes the ink to be moved up to the meniscus forming portion 10 for holding the meniscus forming portion 10 wet. Thus, formation of an ink film is continued in the meniscus forming portion 10 and the pressure holding operation in the main ink chamber 4 by generating bubbles functions effectively. From the condition, the supply pressure of ink to the ink jet head 1 is held constant to complete consumption of the ink in the main ink chamber 4. Therefore, a very efficient ink supply device can be provided.

Thus, the meniscus forming portion 10 is always immersed in ink, so that the negative pressure in the main ink chamber 4 is held substantially constant without destroying the ink meniscus formed on the meniscus forming portion 10 until the ink runs out after bubble generation starts.

Figure 7:
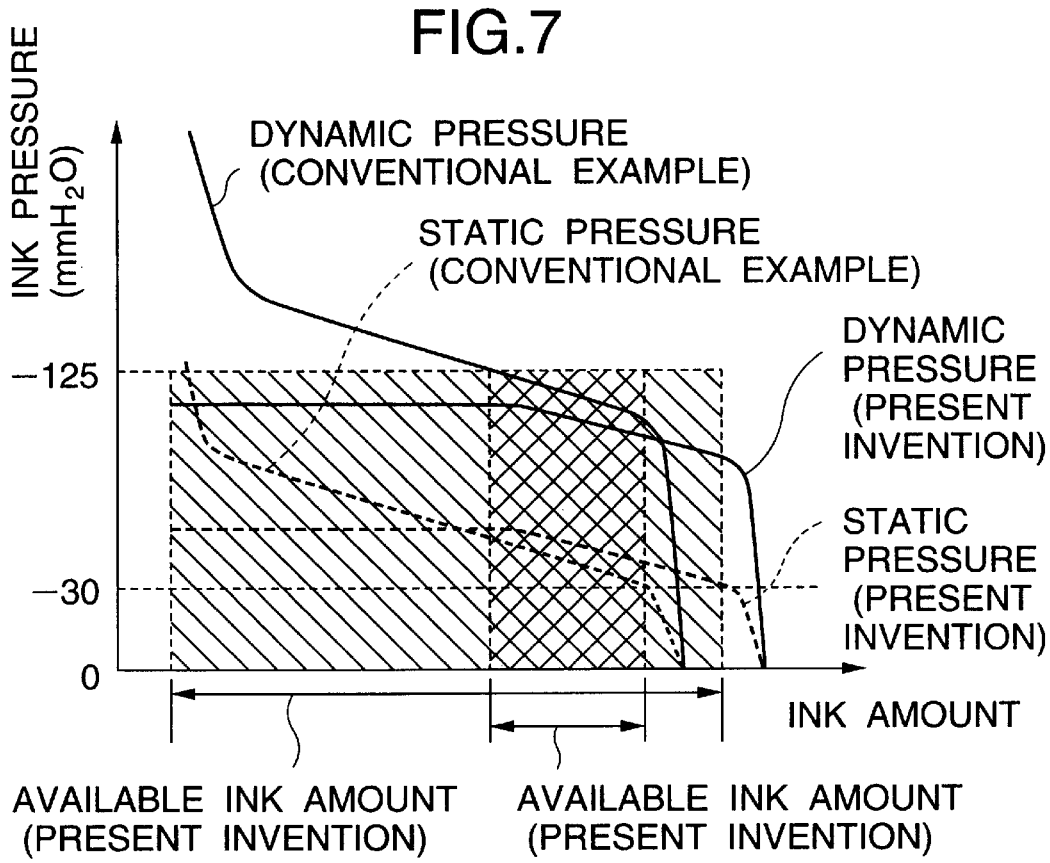
FIG. 7 is an explanatory diagram showing the relationship of ink pressure at ink jet heads to an ink amount.

FIG. 7 is an illustration of the relation of ink pressure at ink jet heads to an ink amount. A change in ink pressure at the ink jet head will affect the jet characteristics of ink from nozzles. In FIG. 7, changes in ink static pressure and ink dynamic pressure at the ink jet head in relation to ink amounts measured using the ink supply device according to the embodiment of the invention shown in FIG. 1 are indicated by a thick line and a thick dotted line. The ink static pressure means pressure when printing is not performed. The pressure is generated by pressure generated by capillary attraction of the absorption member or the meniscus forming portion and the water head from the liquid face of ink. The ink dynamic pressure can be thought of as the sum of an ink flow quantity, a pressure loss generated by fluid resistance of flow passage, and ink static pressure. In FIG. 7, the ink dynamic pressure is measured when contact printing is performed.

Similar measurement was made using an ink tank of the same size as the ink supply device according to the embodiment of the invention with a conventional ink absorber loaded into the entire inner capacity of the ink tank. Changes in the ink static pressure and ink dynamic pressure in relation to an ink amount at the time are indicated by a thin line and a thin dotted line in FIG. 7 for comparison.

Referring to FIG. 7, both do not greatly differ in pressure loss generated by fluid resistance of the flow passage, namely, difference between the solid and broken lines, but differ fairly in ink static pressure. First, the embodiment of the invention has a larger initial fill amount of ink because its ink tank can be filled with a larger amount of ink.

With the conventional ink tank, the ink static pressure rises in rough proportion to a decrease in the remaining amount of ink because the water head of ink from the head face decreases. In the embodiment of the invention, a rise in the ink static pressure on a similar inclination is observed at the beginning; however, when ink is consumed from the absorption member and bubbles are generated from the meniscus forming portion, the ink static pressure becomes constant. It is considered that the ink pressure is represented as the following expression:

$$Phead=Pair-4\gamma \cos \theta/D+\rho \cdot g \cdot h2$$

where Phead is pressure at the ink jet head, Pair is atmospheric pressure, $\gamma$ is the interfacial tension between the ink and the meniscus forming portion, $\theta$ is wet angle, D is the gap diameter in the meniscus forming portion, $\rho$ is the ink density, g is gravity acceleration, and h2 is the height from the ink liquid face of the meniscus forming portion to the ink jet head. The first and second terms of the expression are determined by the atmospheric pressure and the meniscus forming portion. The water head of ink from the head face on the third term also becomes a constant value because the height h2 becomes constant. Thus, the ink static pressure becomes constant. As a result, the ink dynamic pressure, the sum of an ink flow quantity, a pressure loss generated by fluid resistance of flow passage, and ink static pressure, also becomes constant, providing an efficient ink supply device having a large available ink amount.

It is found in the example that when the negative pressure value at the ink jet head exceeds 125 mm $H_2O$, refilling with ink is hindered, causing the ink drop amount spouted from the nozzles to decrease, causing degradation in print quality, called blur. Thus, in the embodiment of the invention, the ink pressure is held in a proper range in response to a change in the remaining amount of ink, enabling good printing until ink is consumed up.

By the way, the environment will change, for example, outer atmospheric pressure or outer temperature will change. When the main ink chamber is filled up with ink and ink is supplied from the sub ink chamber, the atmospheric pressure that the absorption member receives through the air communication hole is the same as the atmospheric pressure that the nozzle tips of the ink jet head receive. Thus, if the atmospheric pressure changes, pressure balance is kept.

Figure 8A:
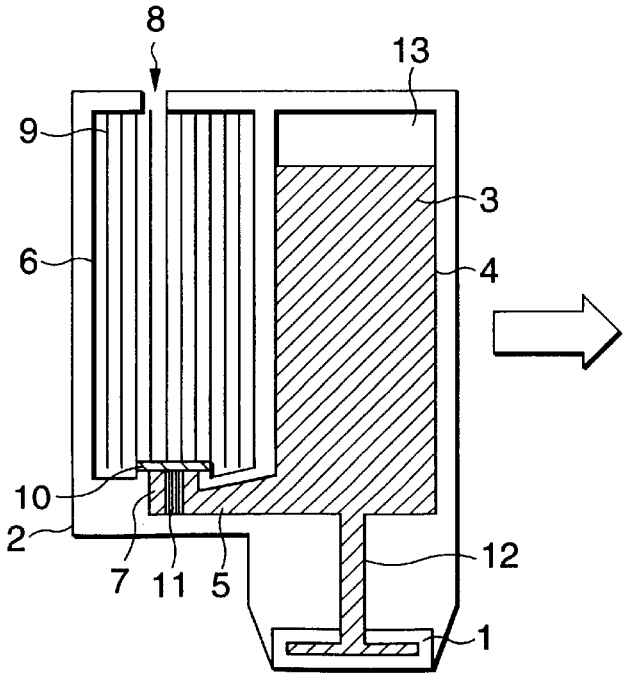
FIGS. 8(A) and 8(B) are explanatory diagrams showing a state in a ink tank when environment changes.
Figure 8B:
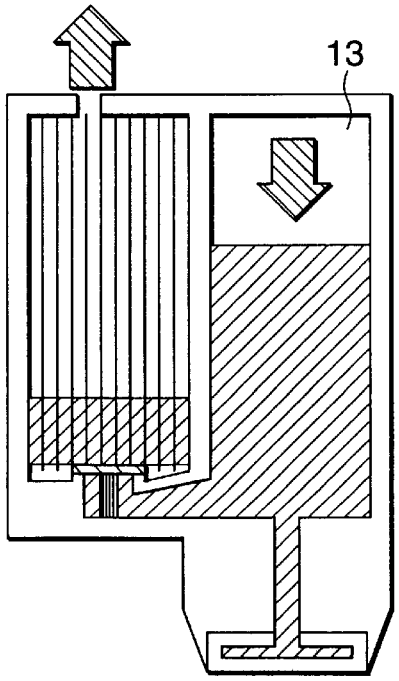

Next, an example in which an air layer is formed in the main ink chamber is discussed. FIGS. 8 and 9 are illustrations of the state in the ink tank when the environment changes. In the figures, numeral 13 is an air layer. When the outer atmospheric pressure falls or the outer temperature rises, the volume of the air layer 13 in the upper portion of the main ink chamber 4 expands, thus the negative pressure value in the main ink chamber 4 attempts to become relatively small. For this reason, as shown in FIGS. 8(A) and 8(B), the ink in the main ink chamber 4 passes through the meniscus forming portion 10 via the communication hole 7, and is absorbed in the absorption member 9 in the sub ink chamber 6, thereby holding the differential pressure between the pressure in the main ink chamber 4 and the atmospheric pressure constant and preventing the ink from being leaked.

Figure 9A:
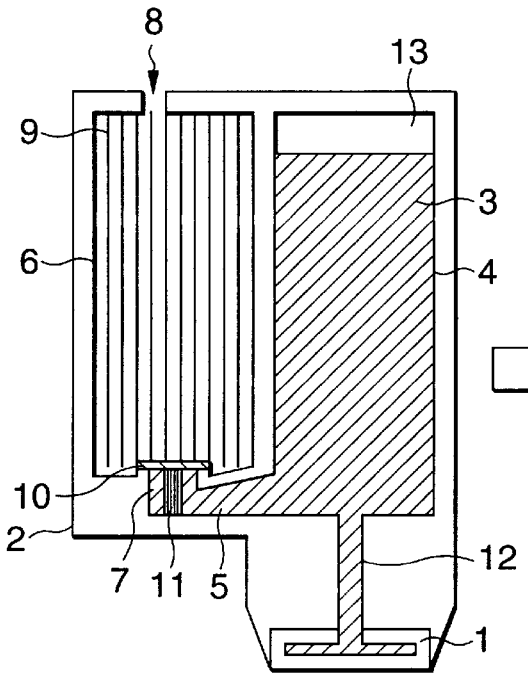
FIGS. 9(A) and 9(B) are explanatory diagrams showing a state in the ink tank when the environment changes in a different way.
Figure 9B:
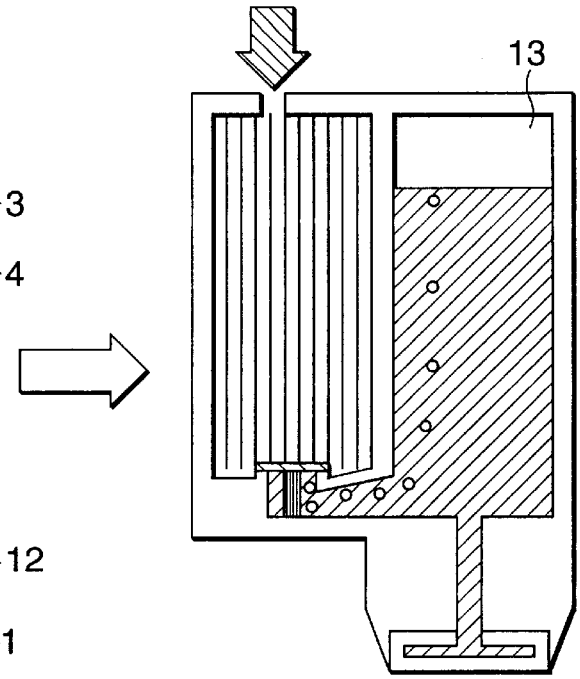

When the outer atmospheric pressure rises or the outer temperature falls, the volume of the air layer 13 in the upper portion of the main ink chamber 4 shrinks, thus the negative pressure value in the main ink chamber 4 attempts to become relatively large. In this case, as shown in FIGS. 9(A) and 9(B), as ink is consumed, air passes through the absorption member 9 via the air communication hole 8 and further passes through the meniscus forming portion 10 and is led into the main ink chamber 4 via the communication hole 7, thereby holding the differential pressure inside the main ink chamber 4 constant. When ink exists in the sub ink chamber 6, the ink moves to the main ink chamber 4 for holding the negative pressure in the main ink chamber 4. In either case, ink leakage does not occur.

Figure 10:
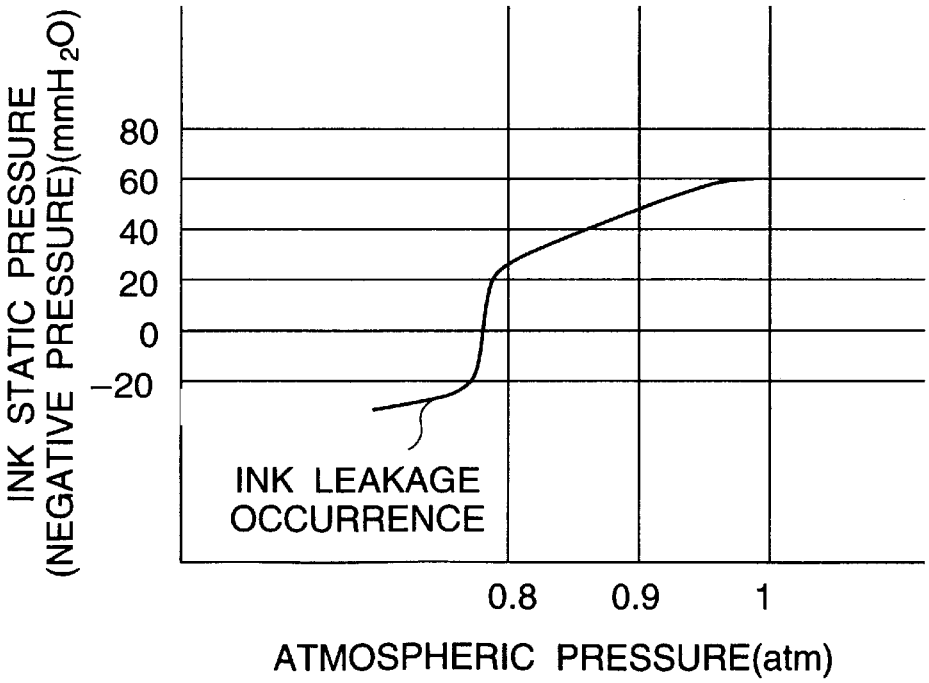
FIG. 10 is an explanatory diagram showing the relationship between atmospheric pressure and ink static pressure.

FIG. 10 is an illustration of the relationship between atmospheric pressure and ink static pressure. The ink supply device shown in FIG. 1 was installed in a pressure reducing chamber and the ambient pressure was reduced gradually at the change rate of 0.02 atmospheres/hour. FIG. 10 shows change in ink negative pressure value occurring at the ink jet head 1 at the time provided the remaining amount of ink in the ink tank 2 was 40% of the inner capacity of the ink tank 2 and an air layer 13 as large as a half of the inner capacity of the main ink tank 4 was formed in the main ink tank 4. The air layer was generated by air moving through the meniscus forming portion to the inside of the ink chamber, as described with reference to FIGS. 9(A) and 9(B).

The ink negative pressure value at the ink jet head in the state before pressure reduction, namely, in the state of 1 atmosphere is negative pressure of 60 mm $H_2O$. As the ambient atmospheric pressure is reduced gradually, the negative pressure value in the ink tank lessens relatively. At the time, the pressure of the air layer 13 in the main ink chamber 4 increases relatively and the air layer 13 expands, as described above. Thus, ink starts moving from the main ink chamber 4 to the sub ink chamber 6 through the ink leading portion 11 formed under and in contact with the meniscus forming portion 10. The ink moving to the sub ink chamber 6 is absorbed in the absorption member 9. Since ink is again supplied to the absorption member 9, the interfacial tension with the ink is determined by the interfiber gap diameter of the absorption member 9. At the time, it is considered that the ink negative pressure value corresponding to the ink amount in the sub ink chamber 6 affects the ink jet head 1 according to the ink static pressure curve before bubble generation starts shown in FIG. 7.

In FIG. 10, the negative pressure value at the ink jet head 1 is held 20 mm $H_2O$ or more by the fact that ink moves from the main ink chamber 4 to the sub ink chamber 6 until the atmospheric pressure becomes 0.8 atmospheres. If the atmospheric pressure falls below the value, the amount of ink moving to the sub ink chamber 6 exceeds the amount in which the absorption member 9 can hold negative pressure; negative pressure cannot be held and the negative pressure value at the ink jet head 1 lowers rapidly, causing ink to leak. At the time, the atmospheric pressure at which ink leaks can be furthermore lowered by increasing the ink holding capacity of the absorption member 9. Thus, resistance to outer atmospheric pressure change or outer temperature change changes by changing the capacity ratio of the main ink chamber 4 to the absorption member 9 in the sub ink chamber 6.

In the description of the volume efficiency given above, the capacity ratio of the main ink chamber 4 to the sub ink chamber 6 is 1:1. The ink holding efficiency of the absorption member 9 in the sub ink chamber 6 is, for example, about 80% rather than 100%. Thus, preferably the capacity of the absorption member 9 is small if the volume efficiency of the ink supply device is considered. However, if the change in atmospheric pressure described above is considered, the capability of absorbing the atmospheric pressure change would be enhanced with a larger capacity of the absorption member 9. Therefore, the capacities of the main ink chamber 4 and the absorption member 9 should be determined from the viewpoints of both the ink use efficiency and resistance to outer atmospheric pressure change and outer temperature change.

The capacity ratio of the main ink chamber 4 to the sub ink chamber 6 will be preliminary calculated under certain conditions. Here, cases where the atmospheric pressure lowers and the ambient temperature rises are considered. In the opposite cases, there is no problem because the air layer 13 in the main ink chamber 4 shrinks and negative pressure is held as ink is consumed normally. In the description to follow, assume that atmospheric pressure change is within 0.15 atmospheres and that temperature change ranges from 25 to 70° C. Let the capacity of the main ink chamber 4 be X and that of the absorption member 9 in the sub ink chamber 6 be Y.

Assume that the initial static pressure at the ink jet head 1 is 50 mm $H_2O$. One atmosphere is 10332 mm $H_2O$. Assuming that ink leakage occurs when the static pressure at the ink jet head 1 becomes negative, the atmospheric pressure change until the ink leakage occurs is consumed to relieve the initial negative pressure. Therefore, the change amount in the atmospheric pressure is $$0.15-0.005=0.145 \text{ (atm)}$$

The subsequent change can be thought of constant pressure volume change. Assuming that P·V=nRT=constant (where P is atmospheric pressure, V is volume, R is a gas constant, and T is absolute temperature), the ink leakage amount is considered to be equivalent to the volume change. Here, assuming that the volume after change is V' and that the amount of change is ΔV', $$V'=1.145\ V$$

$$\Delta V'=0.145\ V$$

The temperature change (from 25° C.(T) to 70° C.(T')) also contributes to volume expansion. Thus, assuming that the volume after change is V" and that the amount of change is ΔV", $$V''=(T'/T)V=(343/298)V=1.15\ V$$

$$\Delta V''=0.15\ V$$

Here, the change in vapor pressure of ink also contributes to volume expansion. Thus, assuming that the volume after change is V'" and that the amount of change is ΔV'", $$\Delta V'''=(0.31-0.03)V=0.28\ V$$

Assuming that the volume change when the effects of the atmospheric pressure change, temperature change, and vapor pressure change are considered is ΔV"", $$\Delta V''''=\Delta V'+\Delta V''+\Delta V'''$$

$$=0.145\ V+0.15\ V+0.28\ V=0.575\ V$$

Thus, the volume expansion becomes 0.575·X.

Assuming that the total capacity of the main ink chamber 4 and the absorption member 9 is 1, $$X+Y=1$$

Assuming that the actual use efficiency of the absorption member 9 is 56%, the following two relations must hold in order to absorb the volume expansion:

$$0.56\ Y \geqq 0.575\ X$$

$$Y \geqq 1.03\ X\ (\approx X)$$

If these relational expressions are substantially satisfied and the capacity of the main ink chamber 4, X, is made as large as possible, the capacity ratio of the main ink chamber 4 to the absorption member 9 becomes substantially 50%:50%. At the time, the ink holding efficiency H, the use efficiency S, and the actual use efficiency J are $$H=50+50\times0.8=90(\%)$$

$$S=50+50\times0.7=85(\%)$$

$$J=S\times H=0.9\times0.85=77(\%)$$

In the calculation, the allowable atmospheric pressure change is 0.15 atm and temperature change is 25° C. to 70° C. If these allowable values are changed, the capacity ratio of the main ink chamber 4 to the absorption member 9 changes. In the calculation, various conditions such as the ink holding capability of the absorption member 9, the static pressure at the ink jet head 1, and the ink vapor pressure are assumed; the capacity ratio of the main ink chamber 4 to the absorption member 9 may be determined based on the conditions.

Figure 11:
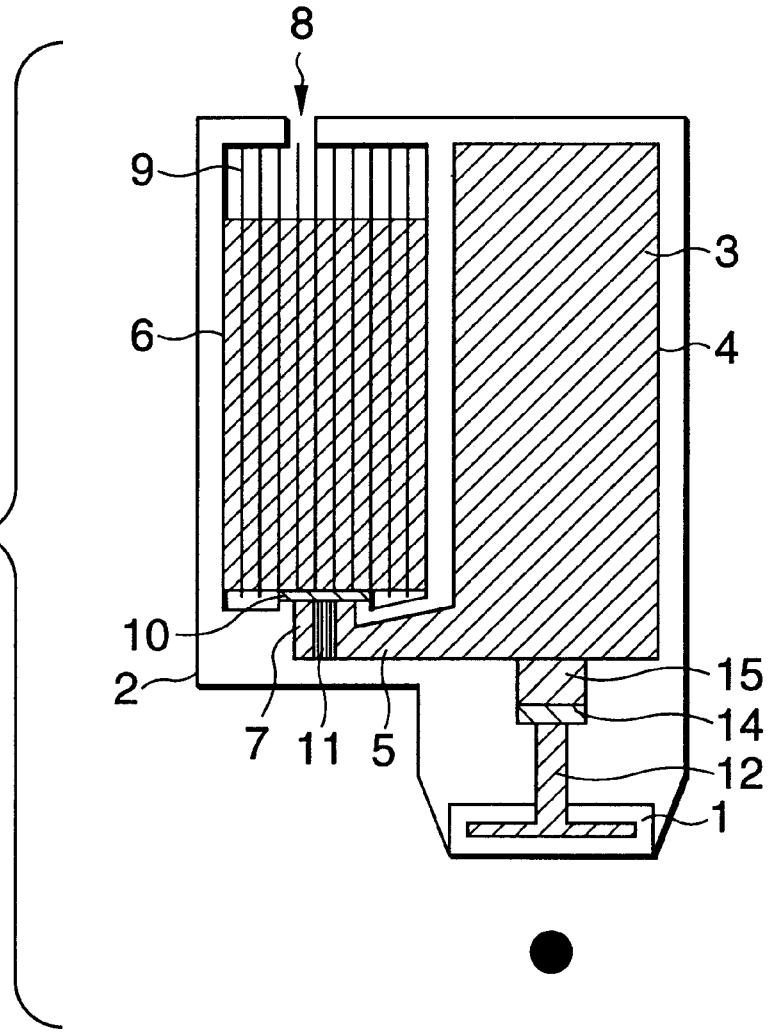
FIG. 11 is a sectional view showing an ink supply device according to another embodiment of the invention.

FIG. 11 is a sectional view showing an ink supply device according to another embodiment of the invention. Parts identical with or similar to those previously described with reference to FIG. 1 are denoted by the same reference numerals in FIG. 11 and will not be discussed again. Numeral 14 is a filter and numeral 15 is a buffer. The embodiment is the same as the embodiment shown in FIG. 1 except that the filter 14 and the buffer 15 are inserted between a main ink chamber 4 and a supply passage 12. The filter 14 is located under the buffer 15, whereby filtering is enabled at the end of the supply passage leading to an ink jet head 1 and dust, foreign material, etc., can be removed securely. The filter 14 is bonded to the top of the supply passage 12 by ultrasonic welding, thermal welding, or the like. Meshes having the filtration grain size ranging from 5 μm to 50 μm, base substance provided by forming SUS thread like felt and further compressing and sintering it, or the like can be used as material of the filter 14. The filtration grain size is determined in the degree to which foreign material larger than the ink flow path diameter in the ink jet head is trapped.

The relationship between a meniscus forming portion 10 and the filter 14 is determined so that the former becomes coarser than the latter. For example, the filtration precision of the meniscus forming portion 10 can be set to 70 μm and that of the filter 14 can be set to 20 μm. When the ink supply device is allowed to stand in a condition such as lateral placement, ink may be out of contact with the meniscus forming portion 10 or the filter 14 if the remaining amount of ink is small. When the outer temperature rises or the outer atmospheric pressure decreases in the state and the negative pressure in the main ink chamber lessens relatively, ink does not move to an absorption member 9 and the inner pressure of the main ink chamber rises considerably. Capillary attraction generated by the meniscus in the meniscus forming portion 10 is made smaller than capillary attraction generated by the meniscus formed on nozzles of the ink jet head 1 or the filter 14, whereby expanded air destroys the meniscus in the meniscus forming portion 10 and moves to a sub ink tank 6, thus preventing ink from leaking from the ink jet head nozzles. The filter 14 also has the effect of suppressing excessive pressure change given to the ink jet head 1 when vibration, shock, or acceleration occurs.

The buffer 15 is made of material such as inner cotton material provided by bundling polyester fiber in one direction like the absorption member 9. Preferably, the buffer 15 is located just before the port of the supply passage 12; it prevents pressure change caused by vibration, shock, or acceleration and bubble mixing from the nozzles of the ink jet head 1.

Figures 12A, 12B:
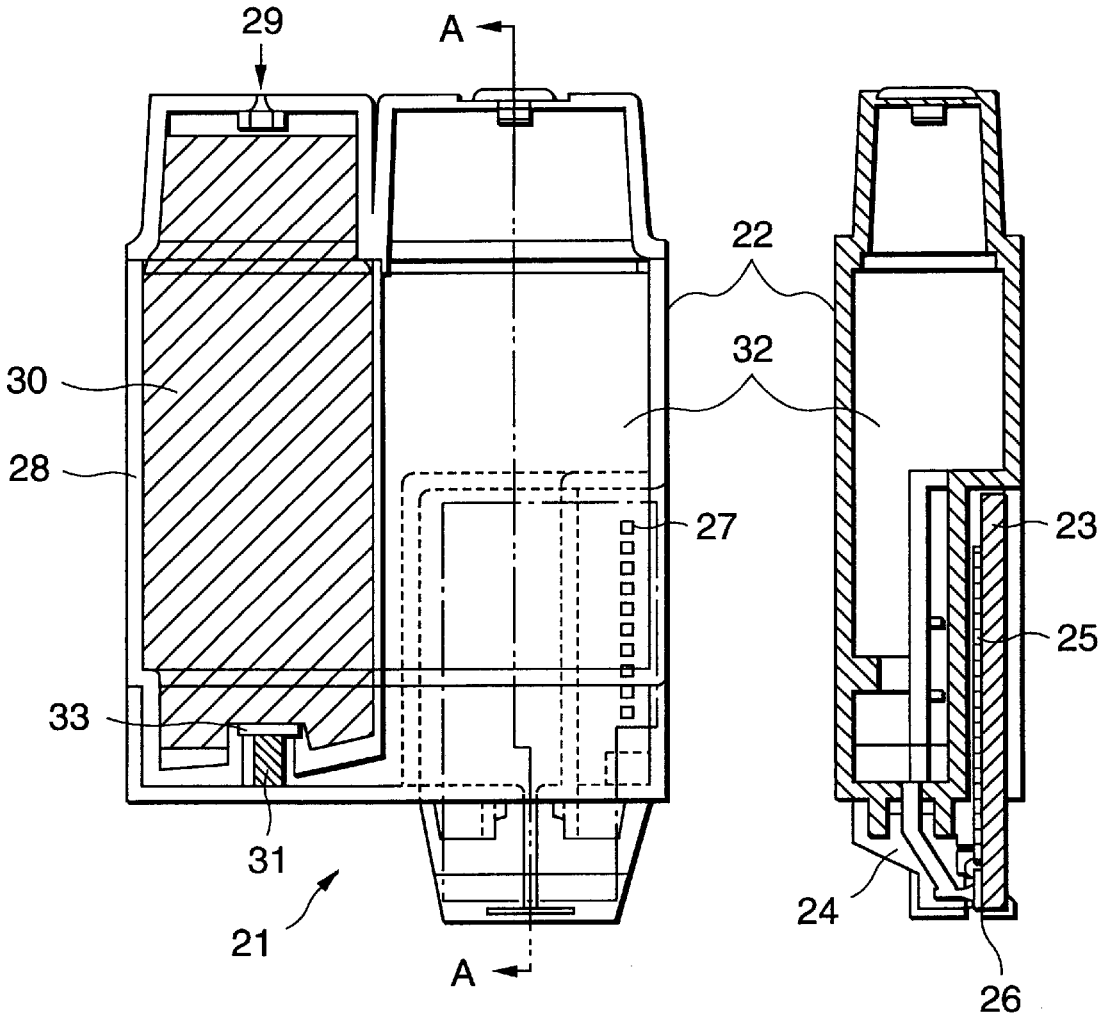
FIGS. 12(A) and 12(B) are schematic structural diagrams showing an ink jet recording unit using the ink supply device of the invention.

FIGS. 12(A) and 12(B) are schematic structural diagrams of an ink jet recording unit using the ink supply device of the invention. In the figure, numeral 21 is an ink jet recording unit, numeral 22 is an ink tank, numeral 23 is a radiating plate, numeral 24 is a flow path forming member, numeral 25 is a board, numeral 26 is an ink jet head, numeral 27 is a wiring pad, numeral 28 is a sub ink chamber, numeral 29 is an air communication hole, numeral 30 is an absorption member, numeral 31 is an ink leading portion, numeral 32 is a main ink chamber, and numeral 33 is a meniscus forming portion.

The ink jet recording unit 21 consists of components such as the ink tank 22, the radiating plate 23, the flow path forming member 24, the board 25, the ink jet head 26, and the wiring pad 27. The ink tank 22 consists of the sub ink chamber 28, the air communication hole 29, the absorption member 30, the ink leading portion 31, the main ink chamber 32, and the meniscus forming portion 33. The ink jet head 26 and the board 25 are located on the radiating plate 23 and electric connection is made by wire bond, etc. Electric signals from a recording apparatus (not shown) are transferred via the wiring pad 27 on the board 25. A drive circuit, etc., is located on the board 25 for controlling a heating element mounted on the ink jet head 26 for spouting ink through the nozzles. On the other hand, ink is supplied from the ink tank 22, as described above. Ink supplied from the ink tank 22 is sent to the ink jet head 26 via an ink supply passage defined by the flow path forming member 24, and is spouted through the nozzles of the ink jet head 26 for printing.

The ink jet recording unit 21 shown in FIGS. 12(A) and 12(B) comprises the ink tank integral with the ink jet head; the ink supply device of the invention can be used to provide a compact recording unit which is good in ink use efficiency. In such a form, the ink jet recording unit 21 is mounted detachably on the recording apparatus. Thus, when the ink tank runs out of ink, the ink jet head will also be replaced. However, since the available ink amount can be increased as compared with former ink tanks, the replacement interval can be prolonged, reducing costs and lessening wastes. Of course, the ink tank can also be made a separate unit for unit replacement.

As described above, according to the invention, the ink supply device, which comprises the main ink chamber for storing ink in the ink tank, the sub ink chamber containing the absorption member, the meniscus forming portion, and the ink leading portion, can lead air into the main ink chamber in response to a pressure fall in the ink chamber as ink is consumed by printing for keeping an ink pressure change affecting the ink jet head within a proper range for always providing good picture quality. Ink in the sub ink chamber can be consumed up and even when the main ink chamber contains a small amount of ink, a pressure change in the main ink chamber can be suppressed for printing for improvement in use efficiency of ink. Further, even if pressure in the main ink chamber changes as the environment changes, ink does not leak and appropriate pressure can be maintained for good printing.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink supply device for supplying ink to an ink jet head, the ink supply device comprising:

a sub ink storage chamber having an air/ink communication hole in a lower side thereof and an air communication hole above the air/ink communication hole, the air/ink communication hole having a cross-section along a first plane;

an ink absorption member positioned within the sub ink storage chamber;

a main ink storage chamber for storing ink, the main ink storage chamber having an ink jet head passage connected to the ink jet head for supplying ink to the ink jet head and a connection passage connecting the main ink storage chamber to the sub ink storage chamber through the air/ink communication hole at the lower side of the sub ink storage chamber for transferring ink between the main ink storage chamber and the sub ink storage chamber and admitting air bubbles into the main ink storage chamber;

an ink leading portion within the connection passage and extending toward the sub ink storage chamber; and a meniscus forming and bubble generating portion separate from the ink absorption member and having a first side and a second side opposite the first side, the meniscus forming and bubble generating portion contacting the ink absorption member on the first side and the ink leading portion at the second side and covering the air/ink communication hole of the sub ink storage chamber for forming an ink meniscus to control entry of air from the air communication hole through the ink absorption member into the main ink storage chamber and for generating air bubbles that pass through the ink meniscus and into the main ink storage chamber under predetermined conditions, wherein air and the ink enter the main ink storage chamber through said connection passage, and wherein the cross-section of the air/ink communication hole is larger than a cross-section of the ink leading portion along the first plane, and the meniscus forming and bubble generating portion includes a contact region within which the ink leading portion contacts the meniscus forming and bubble generating portion and a noncontact region within which the ink leading portion does not contact the meniscus forming and bubble generating portion and further wherein the air/ink communication hole and the ink leading portion transfer ink between the main ink storage chamber and the sub ink storage chamber in a first direction and a second direction, the first direction being from the main ink storage chamber through the non-contact region of the meniscus forming and bubble generating portion and into the sub ink storage chamber, and the second direction being from the sub ink storage chamber through the ink leading portion and the contact region of the meniscus forming and bubble generating portion to the main ink storage chamber.

2. An ink supply device as claimed in claim 1, wherein said meniscus forming and bubble generating portion is made of a mesh substance.

3. An ink supply device as claimed in claim 1, wherein said meniscus forming and bubble generating portion is made of a porous substance.

4. An ink supply device as claimed in claim 1, wherein the lower side of the sub ink storage chamber includes a recessed portion spaced from said ink absorption member.

5. An ink supply device as claimed in claim 1, wherein said ink leading portion has a first end in contact with said meniscus forming and bubble generating portion and a second end in contact with a lower surface of the connection passage.

6. An ink supply device as claimed in claim 1, wherein said meniscus forming and bubble generating portion is connected to said ink leading portion to form a single member.

7. An ink supply device as claimed in claim 1, further comprising a filter positioned within the ink jet head passage between said main ink storage chamber and said ink jet head, said filter having higher filtration precision than said meniscus forming and bubble generating portion.

8. An ink supply device for supplying ink jet head, the ink supply device comprising:

a sub ink storage chamber having an air/ink communication hole in a lower side thereof and an air communication hole above the air/ink communication hole, the air/ink communication hole having a cross-section along a first plane;

an ink absorption member positioned within the sub ink storage chamber;

a main ink storage chamber for storing ink, the main ink storage chamber having an ink jet head passage connected to the ink jet head for supplying ink to the ink jet head;

a connection passage having an inclined wall upwardly inclined from the air/ink communication hole provided downward of the sub ink storage chamber toward the main ink storage chamber and a substantially horizontal wall, and connecting the main ink storage chamber to the sub ink storage chamber through the air/ink communication hole, said connection passage bidirectionally transferring ink between the main ink storage chamber and the sub ink storage chamber and conducting air bubbles generated in the air/ink communication hole along the inclined wall;

an ink leading portion within the communication passage and extending toward the sub ink storage chamber; and a meniscus forming and bubble generating portion separate from the ink absorption member and having a first side and a second side opposite the first side, the meniscus forming and bubble generating portion contacting the ink absorption member on the first side and the ink leading portion at the second side opposite the first side and covering the air/ink communication hole of the sub ink storage chamber for forming an ink meniscus to control entry of air from the air communication hole through the ink absorption member into the main ink storage chamber and for generating air bubbles that pass through the ink meniscus and into the main ink storage chamber under predetermined conditions, wherein air and the ink enter the main ink storage chamber through said connection passage, and wherein the cross-section of the air/ink communication hole is larger than a cross-section of the ink leading portion along the first plane, and includes a contact region within which the ink leading portion contacts the meniscus forming and bubble generating portion to bidirectionally transfer ink between the main ink storage chamber and the sub ink storage chamber and a non-contact region within which the ink leading portion does not contact the meniscus forming and bubble generating portion.

9. An ink supply device for supplying ink to an ink jet head, the ink supply device comprising:

a sub ink storage chamber having an air/ink communication hole in a lower side thereof and an air communication hole above the air/ink communication hole;

an ink absorption member positioned within the sub ink storage chamber;

a main ink storage chamber for storing ink, the main ink storage chamber having an ink jet head passage connected to the ink jet head for supplying ink to the ink jet head, the main ink storage chamber communicating with the air/ink communication hole at the lower side of the sub ink storage chamber for transferring ink between the main ink storage chamber and the sub ink storage chamber and admitting air bubbles into the main ink storage chamber;

an ink leading portion within the main ink storage chamber and extending toward the sub ink storage chamber; and a meniscus forming and bubble generating portion separate from the ink absorption member, contacting the ink absorption member and covering the air/ink communication hole of the sub ink storage chamber for forming an ink meniscus to control entry of the air from the air communication hole through the ink absorption member into the main ink storage chamber and for generating air bubbles that pass through the ink meniscus and into the main ink storage chamber under predetermined conditions, wherein air and the ink enter the main ink storage chamber there through, and wherein the ink jet head has a plurality of nozzles that each form a meniscus, and a capillary attraction of the meniscus forming and bubble generating portion is larger than a capillary attraction of the ink absorption member and is smaller than a capillary attraction of the plurality of nozzles and further wherein the air/ink communication hole and the ink leading portion transfer ink between the main ink storage chamber and the sub ink storage chamber in a first direction and a second direction, the first direction being from the main ink storage chamber through a non-contact region of the meniscus forming and bubble generating portion and into the sub ink storage chamber, the non-contact region being where the ink leading portion does not contact the meniscus forming and bubble generating portion and the second direction being from the sub ink storage chamber through the ink leading portion and contact region of the meniscus forming and bubble generating portion to the main ink storage chamber, the contact region being where the ink leading portion contacts the meniscus forming and bubble generating portion.

10. An ink supply device as claimed in claim 9, wherein said meniscus forming and bubble generating portion is made of a mesh substance.

11. An ink supply device as claimed in claim 9, wherein said meniscus forming and bubble generating portion is made of a porous substance.

12. An ink supply device as claimed in claim 9, further comprising a filter positioned within the ink jet head passage between said main ink storage chamber and said ink jet head, said filter having higher filtration precision than said meniscus forming and bubble generating portion.

13. An ink supply device as claimed in claim 9, wherein the lower side of the sub ink storage chamber includes a recessed portion spaced from said ink absorption member.

14. An ink supply device for supplying ink to an ink jet head, the ink supply device comprising:

a sub ink storage chamber having an air/ink communication hole in a lower side thereof and an air communication hole above the air/ink communication hole, the air/ink communication hole having a cross-section along a first plane;

an ink absorption member positioned within the sub ink storage chamber;

a main ink storage chamber for storing ink, the main ink storage chamber having an ink jet head passage connected to the ink jet head for supplying ink to the ink jet head, the main ink storage chamber communicating with the air/ink communication hole at the lower side of the sub ink storage chamber for transferring ink between the main ink storage chamber and the sub ink storage chamber and admitting air bubbles into the main ink storage chamber;

an ink leading portion within the main ink storage chamber and extending toward the sub ink storage chamber; and a meniscus forming and bubble generating portion separate from the ink absorption member and having a first side and a second side opposite the first side, the meniscus forming and bubble generating portion contacting the ink absorption member on the first side and the ink leading portion at the second side and covering the air/ink communication hole of the sub ink storage chamber for forming an ink meniscus to control entry of air from the air communication hole through the ink absorption member into the main ink storage chamber and for generating air bubbles that pass through the ink meniscus and into the main ink storage chamber under predetermined conditions, wherein air and the ink enter the main ink storage chamber therethrough, and wherein the cross-section of the air/ink communication hole is larger than a cross-section of the ink leading portion along the first plane and the meniscus forming and bubble generating portion includes a contact region within which the ink leading portion contacts the meniscus forming and bubble generating portion and a noncontact region within which the ink leading portion does not contact the meniscus forming and bubble generating portion and further wherein the air/ink communication hole and the ink leading portion transfer ink between the main ink storage chamber and the sub ink storage chamber in a first direction and a second direction, the first direction being from the main ink storage chamber through the non-contact region of the meniscus forming and bubble generating portion and into the sub ink storage chamber, and the second direction being from the sub ink storage chamber through the ink leading portion and the contact region of the meniscus forming and bubble generating portion to the main ink storage chamber.

15. An ink supply device as claimed in claim 14, wherein said meniscus forming and bubble generating portion is connected to said ink leading portion to form a single member.

16. An ink supply device as claimed in claim 14, wherein the lower side of the sub ink storage chamber includes a recessed portion spaced from said ink absorption member.

17. An ink supply device as claimed in claim 14, wherein said meniscus forming and bubble generating portion is made of a mesh substance.

18. An ink supply device as claimed in claim 14, wherein said meniscus forming and bubble generating portion is made of a porous substance.

19. An ink supply device as claimed in claim 14, wherein said ink leading portion has a first end in contact with said meniscus forming and bubble generating portion and a second end in contact with a lower surface of the main ink storage chamber.

20. An ink supply device as claimed in claim 14, further comprising a filter positioned within the ink jet head passage between said main ink storage chamber and said ink jet head, said filter having higher filtration precision than said meniscus forming and bubble generating portion.

* * * * *